US005248861A

United States Patent [19]

Kato et al.

[11] Patent Number: 5,248,861

[45] Date of Patent: Sep. 28, 1993

[54] ACCELERATION SENSOR

[75] Inventors: Tomio Kato; Manabu Hatakeyama, both of Tokyo, Japan

[73] Assignee: TDK Corporation, Tokyo, Japan

[21] Appl. No.: 564,522

[22] Filed: Aug. 9, 1990

[30] Foreign Application Priority Data

| | | | |
|---|---|---|---|
| Sep. 22, 1989 | [JP] | Japan | 1-247104 |
| Nov. 8, 1989 | [JP] | Japan | 1-208474 |
| Jul. 17, 1990 | [JP] | Japan | 2-76022[U] |

[51] Int. Cl.[5] ..... H01H 35/02

[52] U.S. Cl. ..... 200/61.45 M; 200/61.45 R

[58] Field of Search ..... 335/280, 153, 205, 206, 335/207; 200/DIG. 29, 61.45 M, 61.45 R; 324/419; 73/488, 517 R, 518, 519, 520, 570, 652, 668; 180/282; 280/734; 307/10.1, 10.2, 121, 415; 340/429, 436, 467, 669

[56] References Cited

U.S. PATENT DOCUMENTS

| | | | |
|---|---|---|---|
| 3,250,871 | 10/1966 | Wigger | 335/205 |
| 3,459,911 | 8/1969 | Fischer | 200/61.45 |
| 3,560,846 | 2/1971 | Bessko | 335/207 |
| 3,942,051 | 3/1976 | Stevinson et al. | 310/15 |
| 4,591,676 | 5/1986 | Jackman et al. | 200/61.45 |
| 4,948,929 | 8/1990 | Fukushima | 200/61.45 M |
| 5,028,750 | 7/1991 | Spies et al. | 200/61.45 M |

FOREIGN PATENT DOCUMENTS

| | | |
|---|---|---|
| 0293784 | 12/1988 | European Pat. Off. . |
| 0341464 | 11/1989 | European Pat. Off. . |
| 2223699 | 10/1974 | France . |
| 1-94265 | 4/1989 | Japan . |

*Primary Examiner*—Marc S. Hoff
*Assistant Examiner*—Michael A. Friedhofer
*Attorney, Agent, or Firm*—Armstrong, Westerman, Hattori, McLeland & Naughton

[57] ABSTRACT

An acceleration sensor is disclosed, which comprises a movable permanent magnet, a case of a non-magnetic material having a space with the movable permanent magnet movable therein, a magnetic yoke provided on the case and extending in a direction crossing the directions of movement of the movable permanent magnet, and a lead switch for forming a closed magnetic circuit together with the movable permanent magnet and magnetic yoke, the lead switch being turned on and off with a movement of the movable permanent magnet caused due to an acceleration produced by shocks or vibrations.

Another acceleration sensor is disclosed, which is operable in response to a predetermined acceleration to open a first magnetic circuit with a permanent magnet and close a second magnetic circuit with the permanent magnet so as to close a lead switch and comprises a movable magnetic member held stationary in the first magnetic circuit and moved in response to a predetermined acceleration in a direction crossing and to close the first magnetic circuit.

14 Claims, 15 Drawing Sheets

ACCELERATION SENSOR

BACKGROUND OF THE INVENTION

1. Field of the Invention

This invention relates to an acceleration sensor used for detecting acceleration of a movable body such as a vehicle, detecting the load bearing property of an elevator or the like and detecting earthquake or other vibrations.

2. Description of the Prior Art

Japanese Patent Disclosure No. 61-50270 shows an acceleration sensor having a construction as shown in FIG. 39.

In this acceleration sensor, a colloidal magnetic fluid consisting of ferrite, for instance, is moved by an acceleration, and the displacement is detected as a change in the dielectric constant or electrostatic capacitance of a capacitor to provide a voltage signal representing the acceleration.

PROBLEMS TO BE SOLVED ACCORDING TO THE INVENTION

In this prior art system, however, the acceleration is Indicated by a voltage signal, and it is necessary to provide an electric signal in comparison with a voltage value obtained when no acceleration is applied. For providing a signal representing acceleration, a logic circuit is necessary. In addition, since the system adopts a process of indirectly detecting acceleration in comparison with a reference value, the construction is complicated. Further, in order to obtain an on-off signal it is necessary to provide a switching circuit and a relay circuit as shown in FIG. 39.

OBJECTS AND SUMMARY OF THE INVENTION

The present invention has an object of providing an acceleration sensor, which permits a reliable on-off signal to be obtained with a simple construction and has satisfactory response character and high reliability.

To attain the above object of the invention, there is provided an acceleration sensor, which comprises a movable permanent magnet, a case of a non-magnetic material having a space with the movable permanent magnet movable therein, a magnetic yoke provided on the case and extending in a direction crossing the directions of movement of the movable permanent magnet, and a reed switch for forming a closed magnetic circuit together with the movable permanent magnet and magnetic yoke, the reed switch being turned on and off with a movement of the movable permanent magnet caused due to an acceleration produced by shocks or vibrations.

With this construction, usually a closed magnetic circuit is held formed by the movable permanent magnet, magnetic yoke and reed switch. When an acceleration due to shocks or vibrations is applied, the movable permanent magnet receives a momentum, the magnetic circuit is opened. When the acceleration vanishes, the movable permanent magnet is returned to the initial position by magnetic forces of attraction, and the closed magnetic circuit is formed again. With this mechanism, an on-off signal can be directly taken out, thus solving the problem discussed above.

Further, by adopting a plurality of combination structures each comprising the magnetic yoke and reed switch and juxtaposed in the direction of movement of the movable permanent magnet, it is possible to detect both acceleration and direction, in which the acceleration is applied.

Further, detection of both applied acceleration and direction of application of the acceleration can be obtained in case of juxtaposing a plurality of combination structures each comprising the magnetic yoke and reed switch in the direction of movement of the movable permanent magnet with at least one of the combination structures replaced with a sole C-shaped magnetic yoke.

The movable permanent magnet may be rod-like in shape for detecting accelerations applied in forward and backward directions of movement of object. If the movable permanent magnet is spherical in shape, it permits detection of accelerations applied not only in the forward and backward directions of movement but in any direction in a horizontal plane.

Further, a magnetic fluid may be provided around the movable permanent magnet to permit reliable movement.

Further, a magnetic gap may be provided in part of the magnetic yoke located in a path forming the closed magnetic circuit for adjusting magnetic forces of attraction by varying the width of the magnetic gap.

Further, by providing the case such that it has an inclined surface such that a central portion in directions of movement of the movable permanent magnet is lowest in level, it is possible to ensure reliable returning of the magnet to the initial position.

According to the invention, there is further provided an acceleration sensor, which is operable in response to a predetermined acceleration to open a first magnetic circuit with a permanent magnet and close a second magnetic circuit with the permanent magnet so as to close a reed switch and comprises a movable magnetic member held stationary in the first magnetic circuit and moved in response to the predetermined acceleration in a direction crossing and to close the first magnetic circuit.

Further, a magnetic fluid may be provided around the movable magnetic member.

BRIEF DESCRIPTION OF THE DRAWINGS

FIG. 21 is a sectional view showing a further embodiment of the invention with a magnetic yoke provided with a magnetic gap;

FIG. 22 is a sectional view showing a modification of ends of the magnetic yoke in the embodiment of FIG. 21;

FIG. 23 is a sectional view showing a modification of a case;

FIGS. 24 to 38 are views showing further embodiments of the invention; and

DESCRIPTION OF THE PREFERRED EMBODIMENTS

Figure 1:
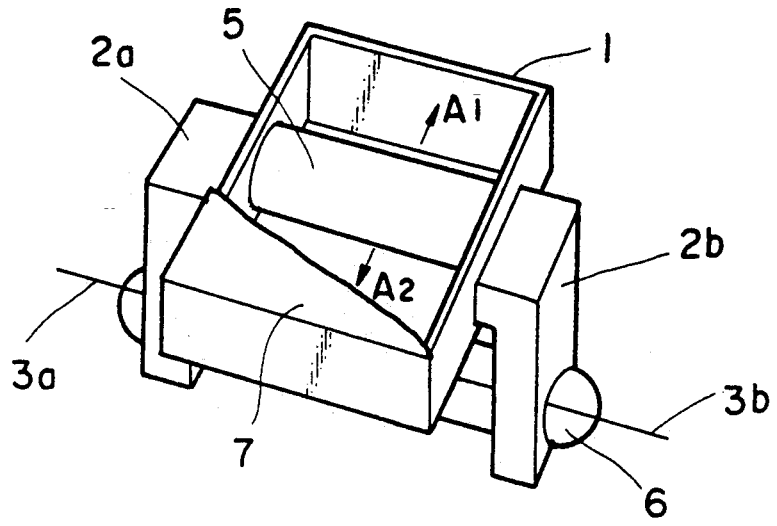
FIG. 1 is a perspective view, partly broken away, showing an embodiment of the invention.
Figure 2:
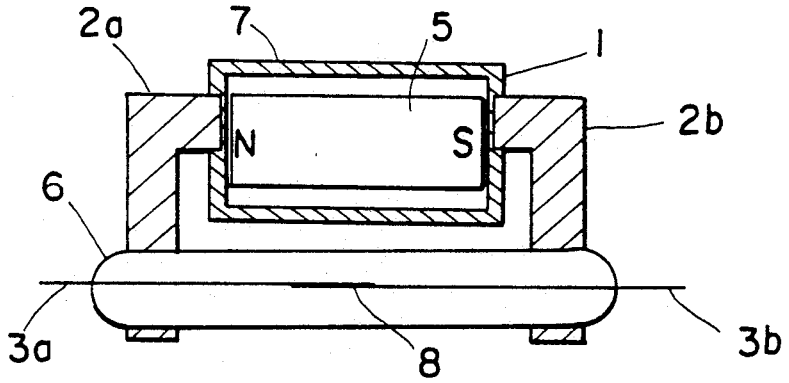
FIG. 2 is a sectional view showing the same embodiment.
Figure 3:
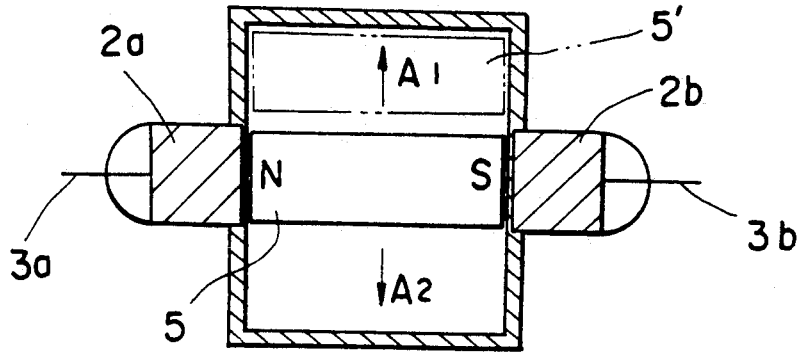
FIG. 3 is a view for explaining the operation of the same embodiment.

FIG. 1 is perspective view, partly broken away, showing an embodiment of the invention, FIG. 2 is a sectional view of the embodiment, and FIG. 3 is a view for explaining the operation of the embodiment.

This illustrated acceleration sensor comprises box-like case 1 of a non-magnetic material, rod-like movable permanent magnet 5 accommodated in case 1, paired magnetic yokes 2*a* and 2*b* provided on opposite sides of case 1 such that they oppose each other and reed switch 6 provided on a lower portion of the magnetic yoke pair.

Case 1 of the non-magnetic material has a space, in which rod-like movable permanent magnet 5 is movable. Movable permanent magnet 5 is movable An case 1 in direction $A_1$ or $A_2$.

Paired magnetic yokes 2*a* and 2*b* have respective bent ends opposing each other in direction perpendicular to direction $A_1$ or $A_2$ of movement of rod-like movable permanent magnet 5. The opposing bent ends have their and faces found in concave formed in case 1.

Reed switch 6 penetrates boles formed in and is secured to lower end portions of paired magnetic yokes 2*a* and 2*b*. It includes a glass tube and paired leads 3*a* and 3*b* sealed in the glass tube and having respective end portions outwardly projecting therefrom.

Reference numeral 8 designates lead contacts.

Rod-like permanent magnet 5, paired magnetic yokes 2*a* and 2*b* and reed switch 6 form a closed magnetic circuit.

Case 1 of non-magnetic material has lid 7 covering rod-like movable permanent magnet 5.

Now, the operation of the embodiment will be described with reference to FIG. 3.

When an impact acceleration in excess of a predetermined value is applied to case 1 in forward direction $A_2$ or backward direction $A_1$ thereof, rod-like movable permanent magnet 5 is moved in direction $A_1$ or $A_2$ according to the impact acceleration. Thus, it gets out of alignment with paired magnetic yokes 2*a* and 2*b* and is brought to a position to strike the inner wall surface of case 1 as shown by phantom line 5'.

As movable permanent magnet 5 is displaced from its position in alignment with paired magnetic yokes 2*a* and 2*b*, the magnetic circuit which has initially been closed is opened.

As shown above, the acceleration sensor has a simple construction comprising a movable permanent magnet, a magnetic yoke pair and a reed switch. In addition, in case where lead switch 6 is initially "on", for instance, it is turned off when an impact acceleration is applied. Thus, whether an impact acceleration in excess of a predetermined value can be readily detected with a sample mechanism of judging of the "on" or "off" state of the reed switch.

When the impact acceleration vanishes, the movable permanent magnet is attracted toward the yokes and is thus returned to the initial position.

Figure 4A:
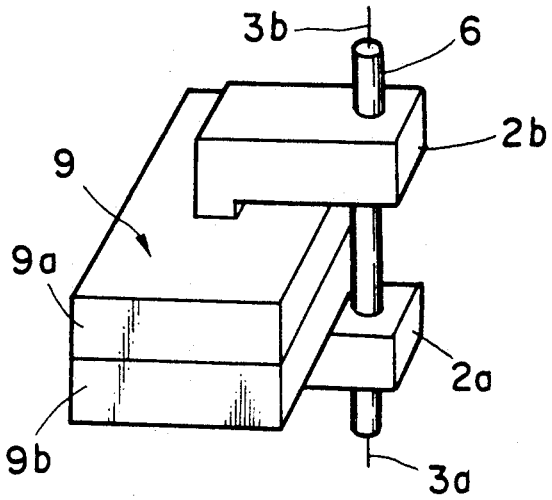
FIGS. 4A and 4B are a perspective view and a sectional view, respectively, showing a different embodiment of the invention.

FIGS. 4A and 48 are a perspective view and a sectional view, respectively, showing a different embodiment of the invention.

This embodiment is different from the preceding embodiment of FIG. 1 in that spherical movable permanent magnet 10 is used in lieu of rod-like movable premanent magnet 5 and that the magnet is movable not only in forward and backward directions but is movable in any direction in horizontal plane intersecting with paired magnetic yokes.

Figure 5A:
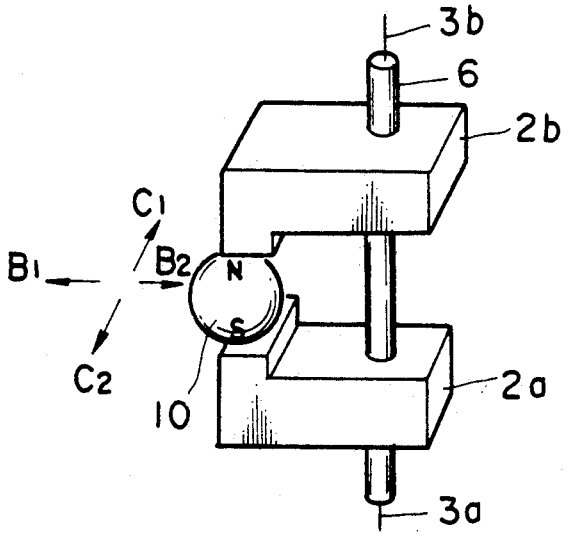
FIG. 5A is a view for explaining the operation of the embodiment of FIGS. 4A and 4B.

More specifically, this acceleration sensor, as shown in FIGS. 4A and 5A, comprises spherical movable permanent magnet 10, case 9 of a non-magnetic material consisting of accommodating section 9*b* accommodating magnet 10 and lid 9*a*, opposing paired magnetic yokes 2*a* and 2*b* provided on the respective upper and lower surface of case 9 and reed switch 6 provided between other ends of the paired magnetic yokes.

Case 9 of non-magnetic material has a space, in which spherical movable permanent magnet 10 is movable. Magnet 10 is movable in case 9 not only in directions $B_1$ or $B_2$ and $C_1$ or $C_2$ but is movable in any direction in horizontal plane.

Opposing ends of paired magnetic yokes 2*a* and 2*b* on the opposite sides of case 9 are mounted on case 9 in the same manner as in the embodiment of FIG. 1.

The other ends of magnetic yokes 2*a* are 2*b* and provided with reed switch 6 in the same manner as in the case of FIG. 1.

Figure 5B:
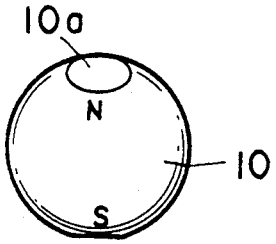
FIG. 5B is a view showing a modification of a movable permanent magnet in the embodiment of FIGS. 4A and 4B.

FIG. 5A shows a contact relation between spherical movable permanent magnet 10 and paired magnetic yokes 2*a* and 2*b*. FIG. 5B shows a modification of magnet 10. In this instance, the magnet is not a perfect sphere but bas local cut and flat surfaces 10*a*. This has an effect of increasing the magnetic forces of attraction.

Figure 6A:
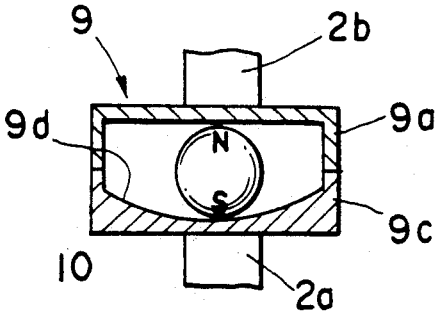
FIGS. 6A and 6B are side views showing modifications of a movable permanent magnet accommodating section in the embodiment of FIGS. 4A and 4B.
Figure 6B:
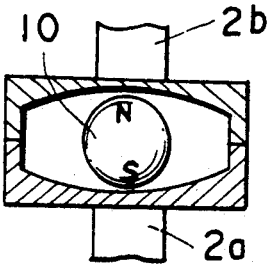

FIG. 6A shows a modification of accommodating section 9*b* accommodating movable permanent magnet 10. This modification has dish-like concave inner bottom surface 9*d* unlike the flat bottom surface in the case of FIGS. 4A, 4B. FIG. 6B shows another modification. In this instance, case 9 has concave ceiling and bottom surfaces. In general, the case bas an inclined surface such that a central portion thereof in directions of movement of the movable permanent magnet is lowest in level. This arrangement has an effect of further promoting the returning of movable permanent magnet 10 to the initial position.

Now, the operation of the above embodiment will be described.

Figure 4B:
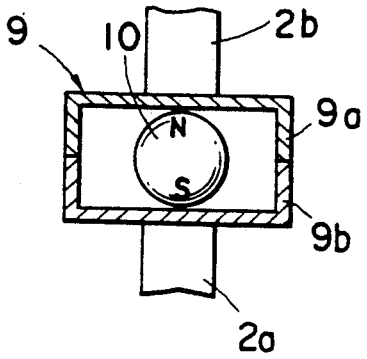

Initially, a closed magnetic circuit is provided by spherical movable permanent magnet 10, paired magnetic yokes 2a and 2b and reed switch 6.

Where case 9b shown in FIG. 4B is used, the accommodating section of which has a flat inner bottom surface, over which movable permanent magnet 10 is movable, an impact acceleration in excess of a predetermined value, applied in any direction in a horizontal plane crossing with the magnetic yokes, causes spherical movable permanent magnet 10 to get out of alignment with paired magnetic yokes 2a and 2b and is brought to a position to be in contact with a side wall of case 9.

Similar operations take place in cases where cases 9c having accommodating sections 9d as shown in FIGS. 6A and 6B are used.

Further, with a spherical movable permanent magnet, the areas of contact with the paired magnetic yokes and pole areas are small compared to the case of a rod-like magnet. The spherical movable permanent magnet, therefore, may be displaced and brought to a position to be in contact with a side wall of the case with slight shocks or vibrations.

With this embodiment, it is possible to readily detect an applied impact acceleration in excess of a predetermined value as in the case of the embodiment shown in FIG. 1. In addition, since the spherical movable permanent magnet con be moved even with slight vibrations, it is possible to detect earthquake or other vibrations.

Figure 7A:
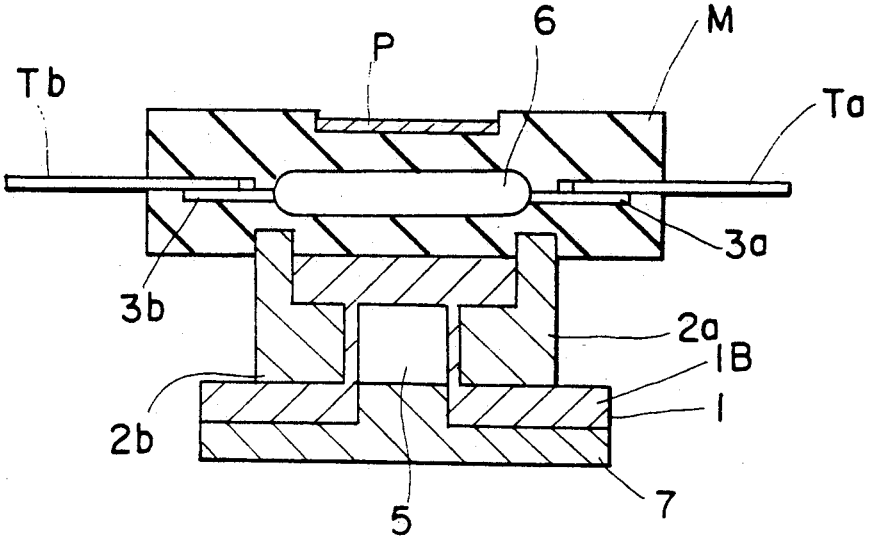
FIGS. 7A and 7B are a front sectional view and a plan sectional view, respectively, showing a specific example of use of the embodiment of FIG. 1.
Figure 7B:
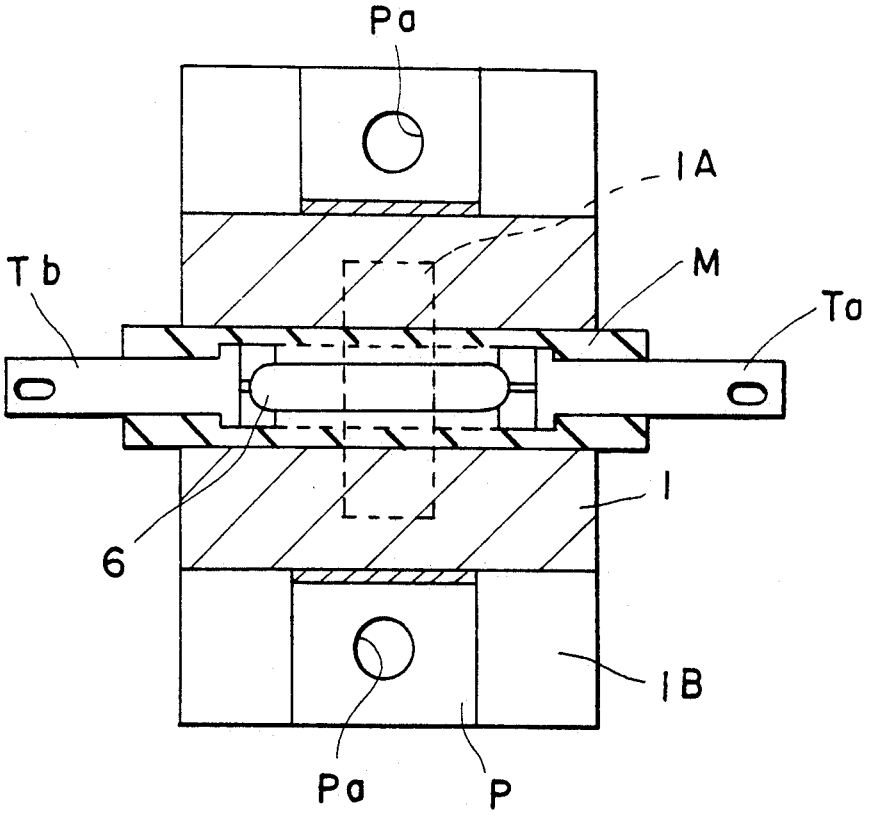

FIGS. 7A and 7B show an example of design of the acceleration sensor shown in FIG. 1 for actual use. A similar example of use of the acceleration sensor shown in FIGS. 4A and 4B may be obtained by replacing the rod-like movable permanent magnet with a spherical one.

FIG. 7A is a front sectional view, and FIG. 7B is a plan sectional view. This example of actual use is shown upside down with respect to FIG. 1. Case 1 of a non-magnetic material is rectangular and has upper and lower flanges. Rod-like movable permanent magnet 5 is accommodated in the rectangular case, and the opening of which is closed by lid 7.

Reed switch 6 is molded with its opposite end leads 3a and 3b connected to strip-like terminals Ta and Tb in resin M entirely, i.e., except for ends of strip-like terminals Ta and Tb, thus protecting the glass tube. With the molded reed switch supported horizontally on the upper flange of case 1, paired L-shaped magnetic yokes 2a and 2b are mounted on the case such that they have their one ends facing the opposite ends of reed switch 6 and other ends facing the position, in which movable permanent magnet 5 is disposed. The entire structure as described above is tightened together by U-shaped metal member P extending from one side of lower flange 1B of case lover the top of resin molding M to the other side of lower flange 1B. Metal member P is secured using holes Pa formed adjacent to its opposite ends and screws by screws inserted through holes formed in it adjacent to its opposite ends and threaded holes formed in lower flange 1B of non-magnetic case 1.

The magnetic forces of the magnetic circuit constituted by the movable permanent magnet, magnetic yoke and reed switch may be appropriately selected for adjusting the sensitivity of detection of shocks or vibrations. Further, it is possible to adjust the detection sensitivity or response character by appropriately selecting the material, size and shape of the movable permanent magnet or adjusting the width of the magnetic gap between the magnetic yoke and movable permanent magnet or adjusting the width of a magnetic gap provided in the magnetic yoke itself.

Figure 8:
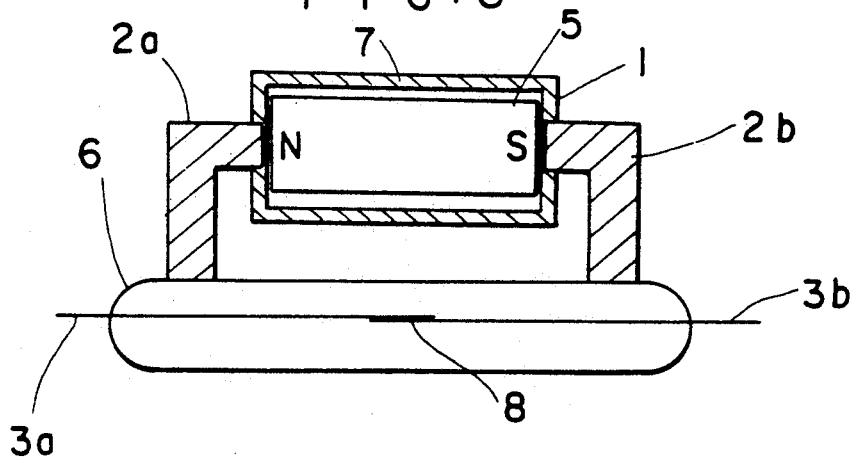
FIG. 8 is a view showing a modification of the construction of magnetic yokes and reed switch.

It is possible to dispose magnetic yokes 2a and 2b on reed switch 6 as shown in FIG. 8.

In either of the above cases, a reed switch with leads sealed in glass is used as switch element, and therefore it is possible to obtain a device, which is not influenced by environments, is free from erroneous operation and is highly reliable.

Figure 9:
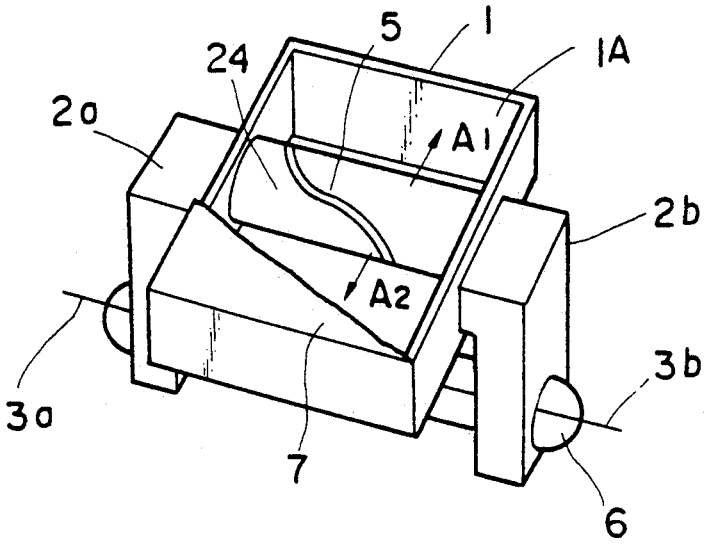
FIG. 9 is a perspective view showing further embodiment of the invention, in which a magnetic fluid is provided around a movable permanent magnet.
Figure 10:
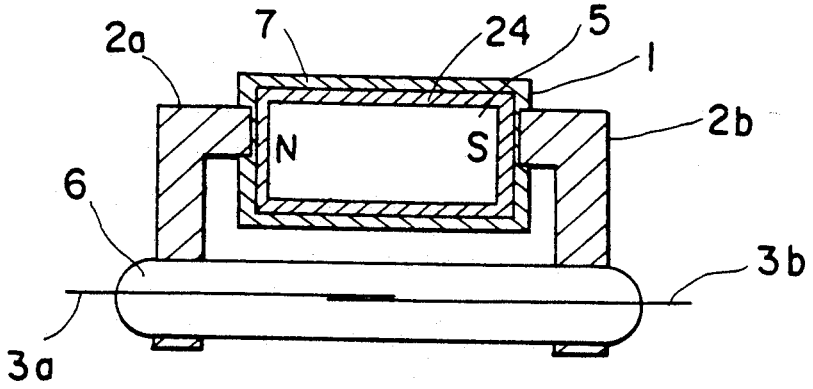
FIG. 10 is a sectional view showing the embodiment of FIG. 9.
Figure 11:
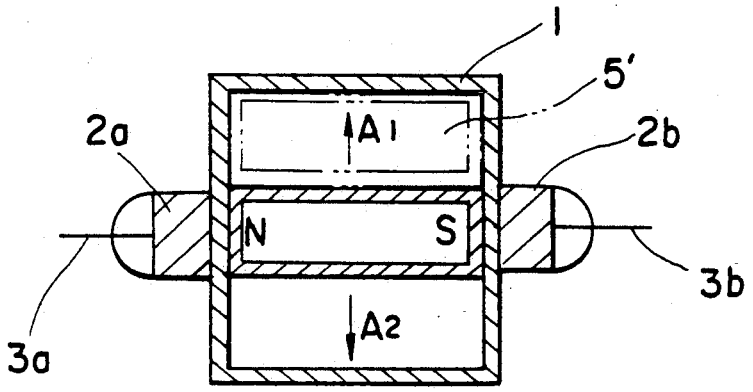
FIG. 11 is a plan view for explaining the operation of the embodiment of FIG. 9.

FIG. 9 is a perspective view, partly broken away, showing a further embodiment of the invention, and FIG. 10 is a side view of the same embodiment, while FIG. 11 is a plan view for explaining the operation of this embodiment.

This acceleration sensor, as shown in FIGS. 9 through 11, comprises box-like case 1, movable permanent magnet 5 accommodated together with surrounding magnetic fluid 24 in the case, paired magnetic yokes 2a and 2b provided opposingly on the opposite sides of case 1 and reed switch 6 provided in a lower portion of the magnetic yoke pair.

Case 1 has a space, in which rod-like movable permanent magnet 5 surrounded by magnetic fluid 24 is movable in directions $A_1$ and $A_2$.

A closed magnetic circuit may be formed by rod-like movable permanent magnet 5 with magnetic fluid 24 there around, paired magnetic yokes 2a and 2b and reed switch 6.

Case 1 is provided with lid 7, which covers rod-like movable permanent magnet 5 surrounded by magnetic fluid 24.

With the above construction, normally a closed magnetic circuit is constituted by movable permanent magnet 5, magnetic fluid 24 surrounding the magnet, magnetic yokes 2a and 2b and reed switch 6. When an impact acceleration is applied, the magnet is moved by receiving a momentum, thus opening the magnetic circuit. When the impact acceleration vanishes, the movable permanent magnet is returned to the initial position, to provide the closed magnetic circuit again.

Further, since movable permanent magnet 5 is surrounded by magnetic fluid 24, the closed magnetic circuit may be formed reliably even if there is a gap between the movable permanent magnet and magnetic yokes.

Figure 12:
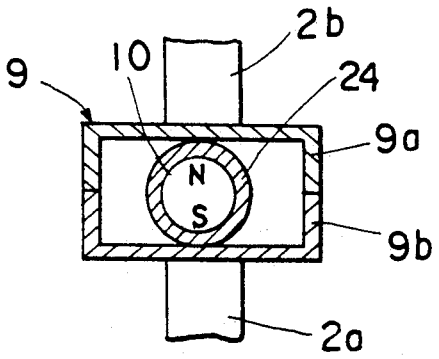
FIGS. 12 to 14 are sectional views showing respective embodiments, in which a magnetic fluid is provided around a movable permanent magnet.
Figure 13:
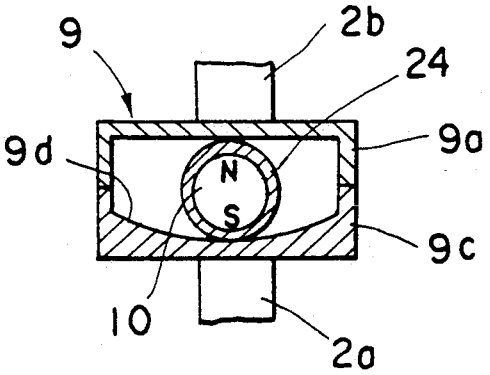
Figure 14:
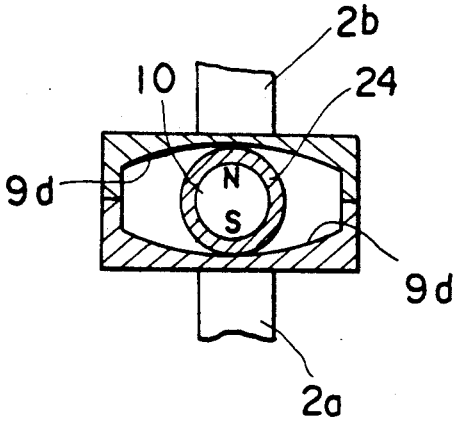

Further, magnetic fluid 24 provides a lubricating function, and therefore with application of an impact acceleration the movable permanent magnet can be moved smoothly, and a possibility of erroneous operation due to catching of the movable permanent magnet if eliminated, FIGS. 12 to 14 show further embodiments of the invention. In the instance of FIG. 12, magnetic fluid 24 is provided around spherical movable permanent magnet 10. The instance of FIG. 13 is a modification of the embodiment of FIG. 12. In this case, case 9 has dish-like inner surface 9d provided at the bottom. The instance of FIG. 14 is another modification of the embodiment of FIG. 12. In this case, both the ceiling and bottom of case 9 are provided with respective dish-like inner surfaces 9d.

With these arrangements, spherical movable permanent magnet 10 can be moved smoothly for it is surrounded by magnetic fluid 24. In addition, with dish-like inner surface 9d provided in case 9 as shown in FIGS. 13 and 14, spherical movable permanent magnet 10 can readily return to the initial position.

Figure 15:
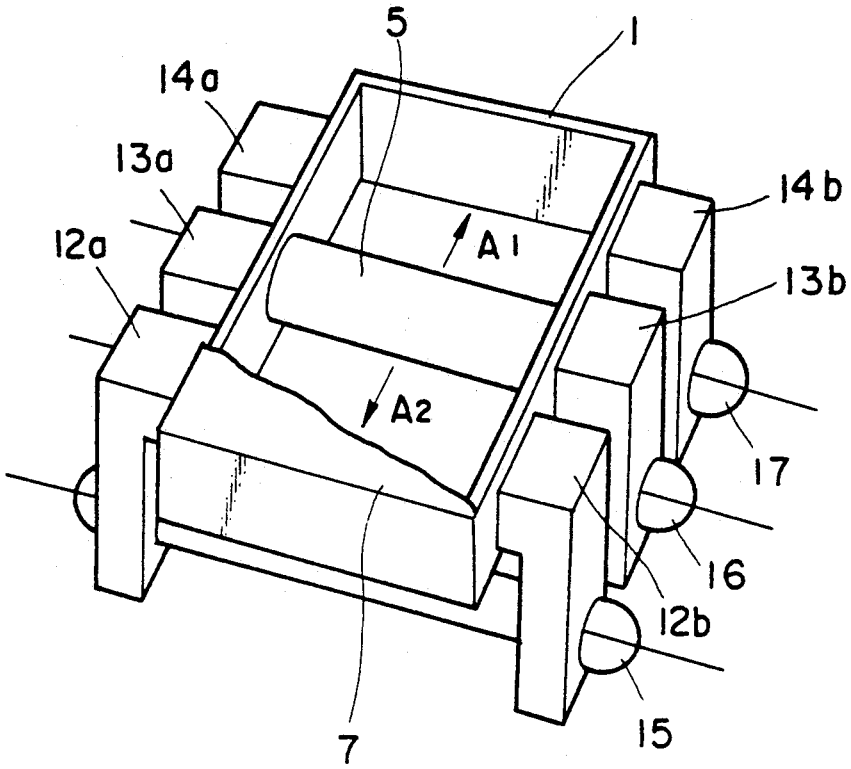
FIGS. 15 to 17 are perspective views showing further embodiments of the invention.

FIG. 15 is a perspective view, partly broken away, showing a further embodiment of the invention.

This embodiment is different from the embodiment shown in FIG. 1 in that three magnetic yoke pairs 12(12*a* and 12*b*), 13(13*a* and 13*b*) and 14(14*a* and 14*b*) are provided in juxtaposing in directions $A_1$ and $A_2$ of movement of movable permanent magnet 5 and reed switches 15, 16 and 17 are each provided in a lower portion of each of the magnetic yoke pairs.

In this embodiment, normally a closed magnetic circuit is formed by movable permanent magnet 5, paired magnetic yokes 13*a* and 13*b* and reed switch 16, while the two other magnetic yoke pairs 12 and 14 form open magnetic circuits.

When an impact acceleration in excess of a predetermined value is applied, movable permanent magnet 5 is moved in direction $A_1$ or $A_2$ to form a closed magnetic circuit with either one of the two other magnetic yoke pairs 12 and 14. By examining the on-off state of reed switches 15 and 17 it is possible to detect application of an impact acceleration in excess of a predetermined value and direction $A_2$ or $A_1$ of application of the impact acceleration.

Figure 16:
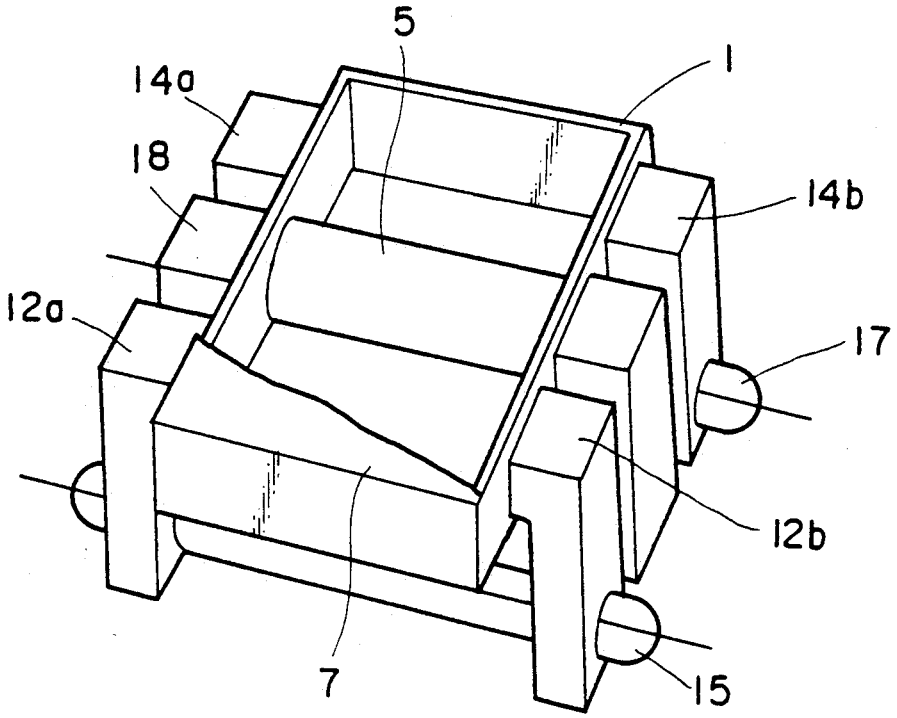

FIG. 16 shows a further embodiment. This embodiment is the same as the embodiment of FIG. 15 insofar as opposite end magnetic yoke pairs 12(12*a* and 12*b*) and 14(14*a* and 14*b*) and associated reed switches 15 and 17 are concerned. The difference resides in central C-shaped magnetic yoke 18, for which no reed switch is provided.

Again with this construction, by examining the on-off state of reed switch 15 or 17 it is possible to detect application of an impact acceleration in excess of a predetermined value and direction of application of acceleration as in the embodiment of FIG. 15.

Figure 17:
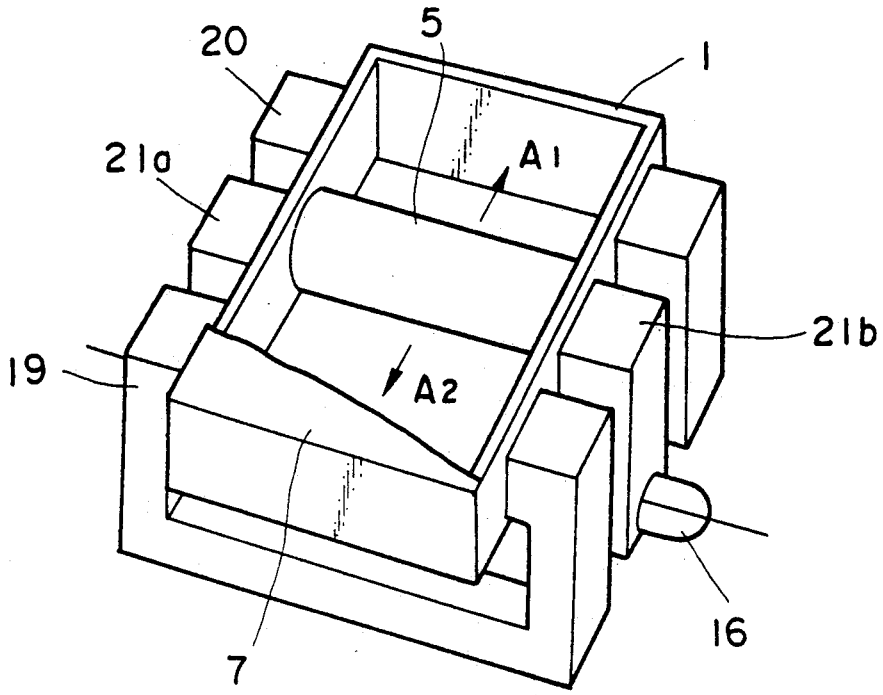

FIG. 17 shows a further embodiment. This embodiment is the same as the previous embodiment of FIG. 15 insofar as the central combination of magnetic yoke pair 21(21*a* and 21*b*) and reed switch 16 is concerned but is different in that opposite side C-shaped magnetic yokes 19 and 20 are provided, for which no reed switch is provided.

With this construction, application of an impact acceleration causes movement of movable permanent magnet 5 in direction $A_1$ or $A_2$. However, magnetic yoke 20 or 19 is not provided with any reed switch. Thus, the same effect as noted above may be obtained by utilizing the fact that the normally closed magnetic circuit is opened with application of an impact acceleration in excess of a predetermined value.

Figure 18:
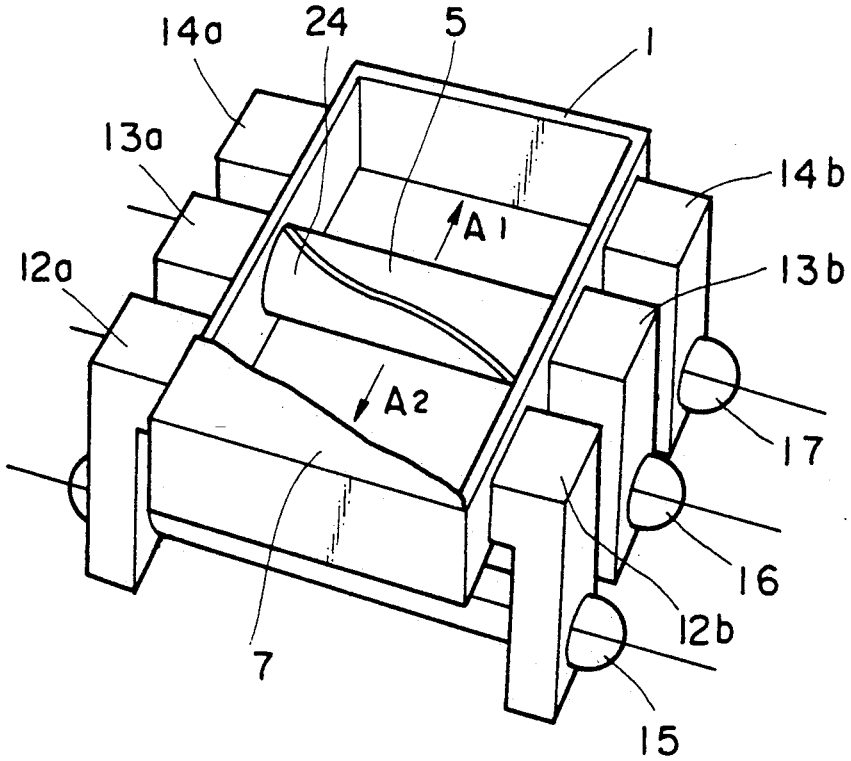
FIGS. 18 to 28 are perspective views showing modifications of the respective embodiments of FIGS. 15 to 17 with a magnetic fluid provided around a rod-like movable permanent magnet.
Figure 19:
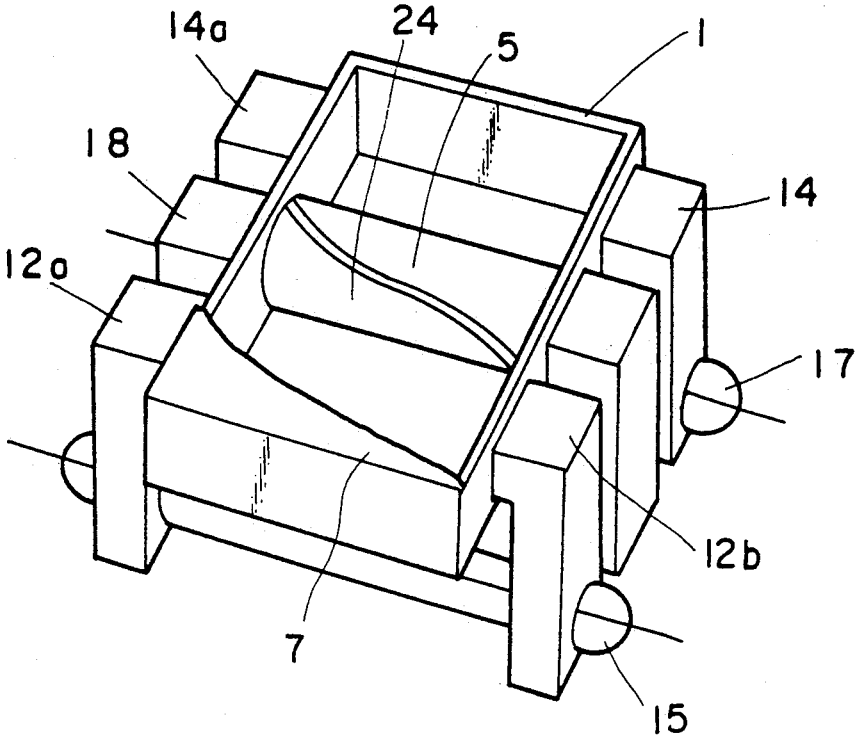
Figure 20:
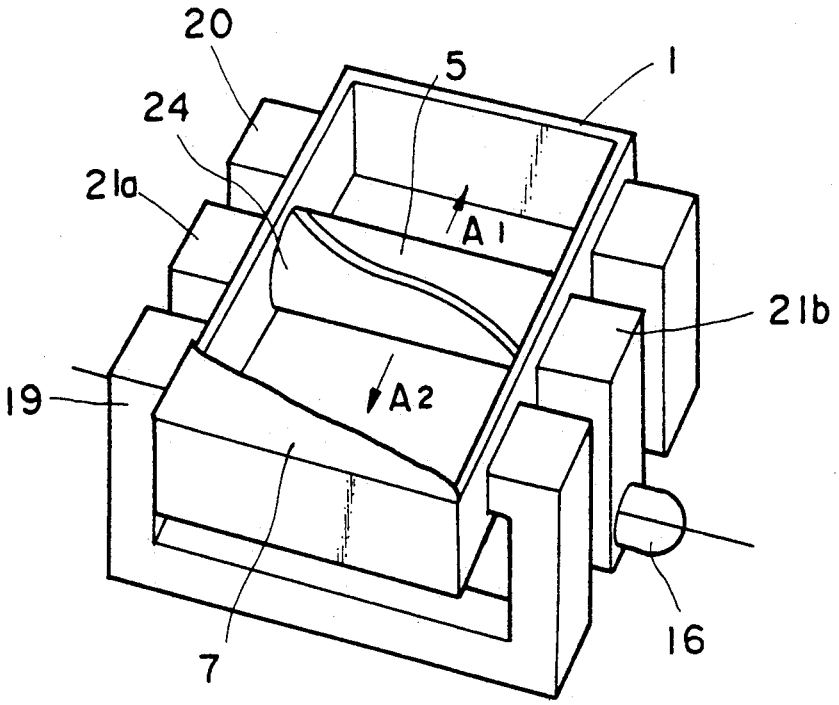

FIGS. 18 to 20 show modifications of the respective embodiments shown in FIGS. 15 to 17. In either instance, rod-like movable permanent magnet 5 is surrounded by magnetic fluid 24. Therefore, in addition to obtaining the same operation and effects as those in the instances of FIGS. 15 to 17, smoother movement of movable permanent magnet and more reliable on-off operation of the magnetic circuit can be obtained.

According to the invention, various further modifications are possible.

Figure 21:
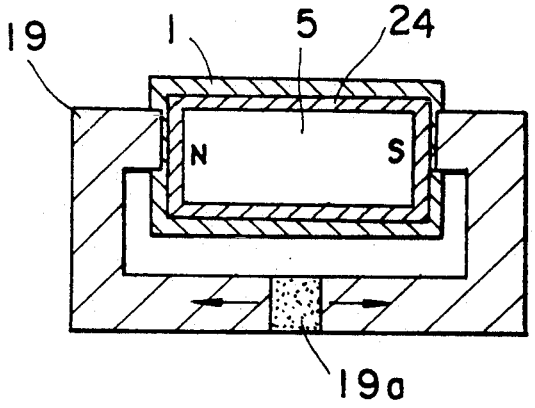

FIG. 21 shows a further modification. In this modification, a central portion of C-shaped magnetic yoke shown in FIG. 20 is provided with central magnetic gap, in which spacer 19*a* is provided. With this arrangement, it is possible to reduce the magnetic flux.

Thus, the magnetic flux can be adjusted by suitably selecting the width of spacer 19*a*, thus permitting adjustment of the impact acceleration detection sensitivity. This arrangement is applicable as well to C-shaped magnetic yokes 18 to 20 in the cases of FIGS. 16, 17 and 19.

Furthermore, this concept is applicable to all the embodiments. For example, in the embodiments of FIGS. 1, 4A, 8, 9, 15 and 18, although no C-shaped magnetic yoke is used, the gap between movable permanent magnet and magnetic yokes can be a magnetic gap, and the magnetic flux can be adjusted by adjusting the distance of this gap.

Figure 22:
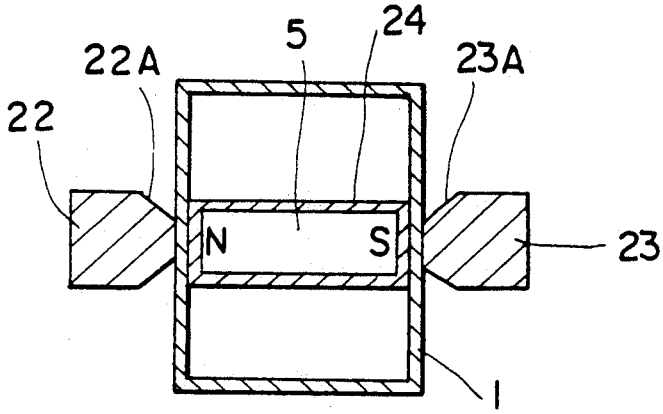

FIG. 22 shows a further modification. In this instance, instead of magnetic yokes 2*a* and 2*b* shown in the embodiment of FIG. 9 magnetic yokes 22 and 23 having tapering ends 22A and 23A are provided opposingly on opposite sides of case 1. In this case, a gradient of magnetic force of attraction is formed such that the magnetic force is maximum at the center of the tapering ends and becomes weaker as one goes away from the center. Thus, at the time of resetting after its movement, movable permanent magnet 5 may be readily returned to the initial position.

Figure 23:
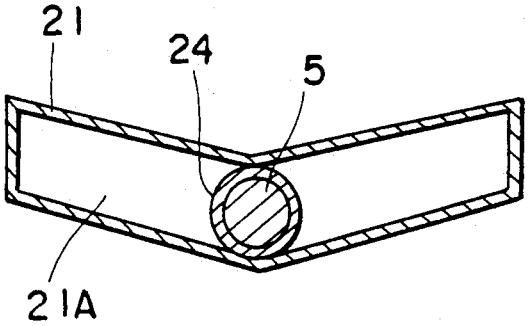

FIG. 23 shows a further modification. In this instance, case 21 has inclined space 21A such that its central portion in the directions of movement of movable permanent magnet 5 is lowest in level, the magnet 5 being provided together with magnetic fluid 24 in the central portion of the space. Movable permanent magnet 5 having been displaced due to an impact acceleration thus can be readily returned to the initial position at the time of the resetting.

The concepts of the arrangements of FIGS. 22 and 23 are of course applicable to the magnetic yokes and case in the other embodiments as well, Further, each embodiment of the acceleration sensor may be utilized as acceleration sensor with a resetting function by providing an external permanent magnet or an external magnetic field of coil, Further, in case of embodiment, in which the magnetic fluid is accommodated in the case, an inert gas such as nitrogen or argon gas may be sealed in the case to prevent solidification of the magnetic fluid.

Further embodiments of the invention will be described with reference to drawings.

Figure 24:
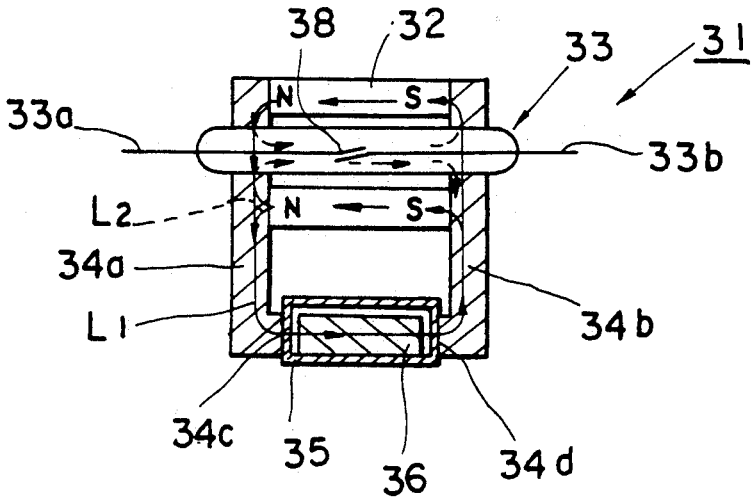
Figure 25:
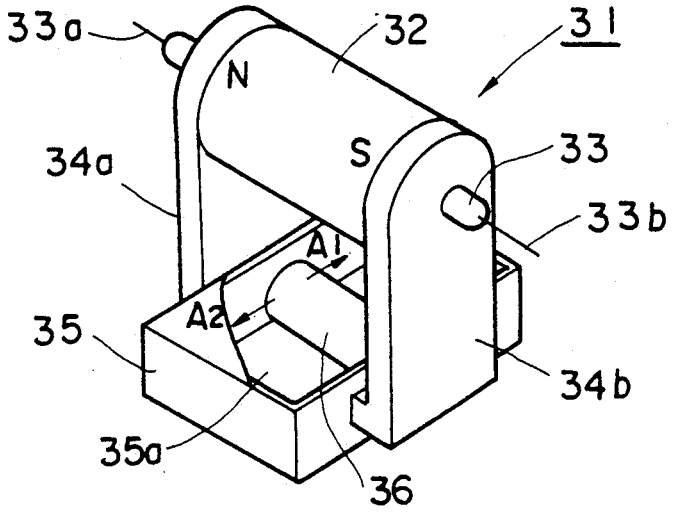

FIG. 24 is a sectional view showing sensor 31 according to the invention, and FIG. 25 is a perspective view showing the same sensor 31.

This sensor 31, as shown, comprises cylindrical permanent magnet 32 capable of forming either first or second magnetic circuit $L_1$ or $L_2$, reed switch 33 disposed through permanent magnet 32 for opening and closing second magnetic circuit $L_2$, magnetic yokes 34*a* and 34*b* opposingly disposed on opposite pole sides of permanent magnet 32 for forming first and second magnetic circuits $L_1$ and $L_2$ and rod-like movable magnetic member 36 disposed for movement in space 35*a* of non-magnetic case 35 for opening and closing first magnetic circuit $L_1$.

When an acceleration in excess of a predetermined value is applied, movable magnetic member 36 is moved in backward direction $A_1$ or forward direction $A_2$ crossing first magnetic circuit $L_1$, as shown in FIG. 25.

Paired magnetic yokes 34*a* and 34*b* have respective bent ends 34*c* and 34*d* extending perpendicular to first magnetic circuit $L_1$ such that a predetermined magnetic force of attraction is generated between end faces 34c and 34d.

Reed switch 33 penetrates holes each formed in one end of each of pair magnetic yokes 34a and 34b. It includes a glass tube and leads 33a and 33b sealed in the glass tube and having ends outwardly projecting in opposite directions. Reference numeral 38 designates lead contacts.

Second magnetic circuit $L_2$ is constituted by permanent magnet 32, paired magnetic yokes 34a and 34b and reed switch 33.

Figure 26:
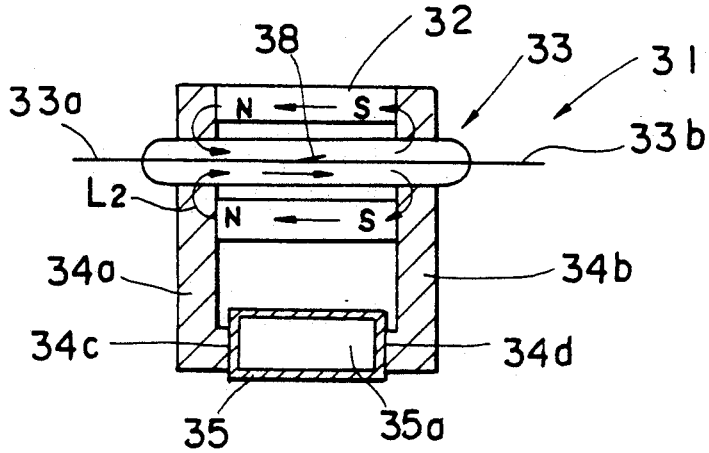

The operation of sensor 31 having the above construction will now be described with reference to FIG. 26.

In a stationary state without any impact acceleration applied to case 35, movable magnetic member 36 is held in first magnetic circuit $L_1$ as shown in FIGS. 24 and 25 by magnetic forces of attraction between bent ends 34c and 34d of magnetic yokes 34a and 34b. In this state, first magnetic circuit $L_1$ is closed.

When first magnetic circuit $L_1$ is closed second magnetic circuit is opened and contacts 38 of reed switch 33 are broken.

When an impact acceleration in excess of a predetermined value is applied to case 35 in forward direction $A_2$ thereof, movable magnetic member 36 is moved in forward direction $A_2$ by the acceleration. Thus, the center of movable magnetic member 36 gets out of first magnetic circuit $L_1$ and brought to a position that movable magnetic member 36 strikes the inner wall of case 35.

With the movement of movable magnetic member 36 first magnetic circuit $L_1$ is opened. When first magnetic circuit $L_1$ is opened, second magnetic circuit $L_2$ is closed, as shown in FIG. 26, and contacts 38 of reed switch 33 are made.

When the impact acceleration vanishes, movable magnetic member 36 is attracted toward first magnetic circuit $L_1$ and is returned to the initial position.

With sensor 31 as described above, with a simple construction comprising the permanent magnet, magnetic yokes and reed switch, a closing operation signal can be obtained as soon as the movable magnetic member is moved. In addition, application of an impact acceleration in excess of a predetermined value can be readily detected from an on-off operation signal from the reed switch.

Figure 27:
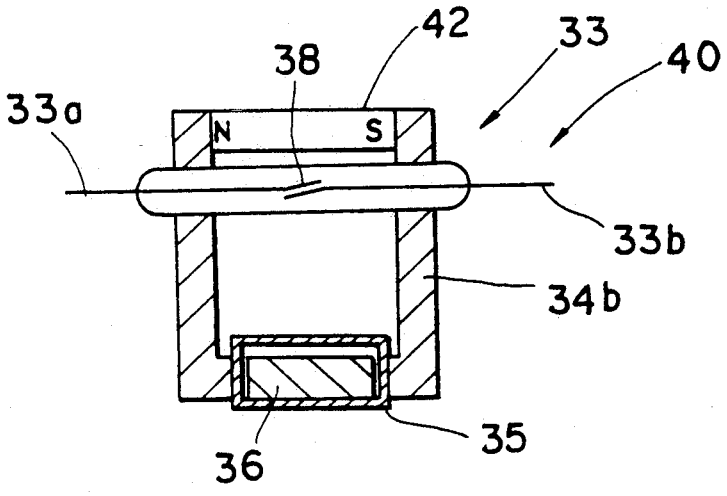
Figure 28:
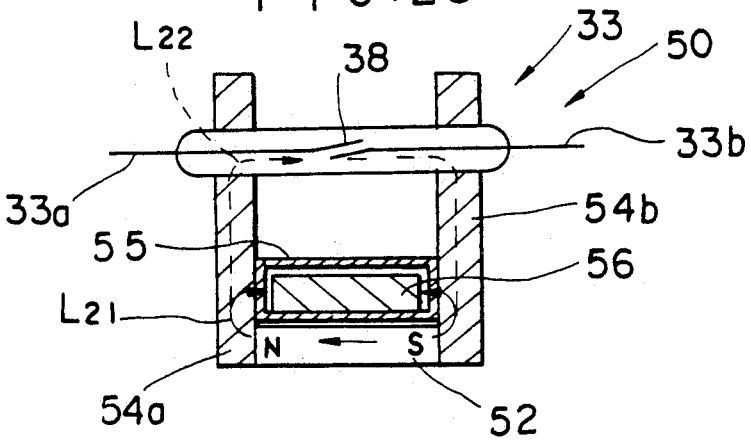
Figure 29:
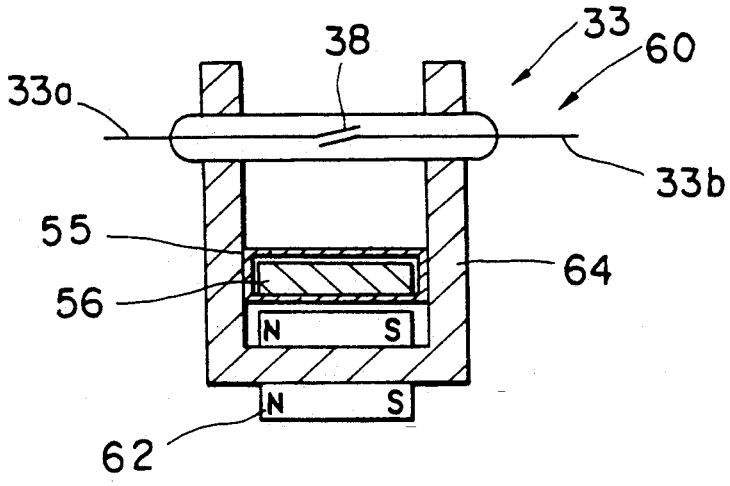

FIGS. 27 to 29 are sectional views showing modifications of sensor 31 shown in FIGS. 24 and 25. In these Figures, parts like those in sensor 31 are designated by like reference numerals or symbols.

Sensor 40 shown in FIG. 27 uses rod-like permanent magnet 42 in lieu of permanent magnet 32 in sensor 31. With this sensor 40, the same operation and effects as those of sensor 31 can be obtained.

In sensor 50 shown in FIG. 28, in lieu of permanent magnet 32 in sensor 31, permanent magnet 52 is provided on the side of movable magnetic member 36. This sensor 50, specifically, comprises permanent magnet 52 provided adjacent to ends of magnetic yokes 54a and 54b and capable of forming first or second magnetic circuit $L_{21}$ or $L_{22}$, reed switch 33 penetrating other ends of magnetic yokes 54a and 54b for opening and closing second magnetic circuit $L_{22}$, non-magnetic case 55 provided in the vicinity of permanent magnet 52 and having the same construction as that in sensor 31, and cylindrical movable magnetic member 56 movable such as to open and close first magnetic circuit $L_{21}$.

Now, the operation of sensor 50 will be described.

In a stationary state without any impact acceleration applied to movable magnetic member 56, movable magnetic member 56 is held attracted to permanent magnet 52, and first magnetic circuit $L_{21}$ is closed. When first magnetic circuit $L_{21}$ is closed, second magnetic circuit $L_{22}$ is open, and contacts 38 of reed switch 33 are broken apart.

When an impact acceleration in excess of a predetermined value is applied to movable magnetic member 56 in forward direction $A_2$, movable magnetic member 56 is moved by the acceleration in forward direction $A_2$, i.e., away from permanent magnet 52.

With this movement of movable permanent magnet 56 first magnetic circuit $L_{21}$ is opened, and second magnetic circuit $L_{22}$ is closed. Contacts 38 of lead switch 33 are thus made.

With this sensor 50, the same effects as obtainable with sensor 31 can be obtained.

In sensor 60 shown in FIG. 29, in lieu of permanent magnet 52 in sensor 50 shown in FIG. 28, cylindrical permanent magnet 62 is used, and U-shaped magnetic yoke 64 extends through permanent magnet 62.

Figure 30:
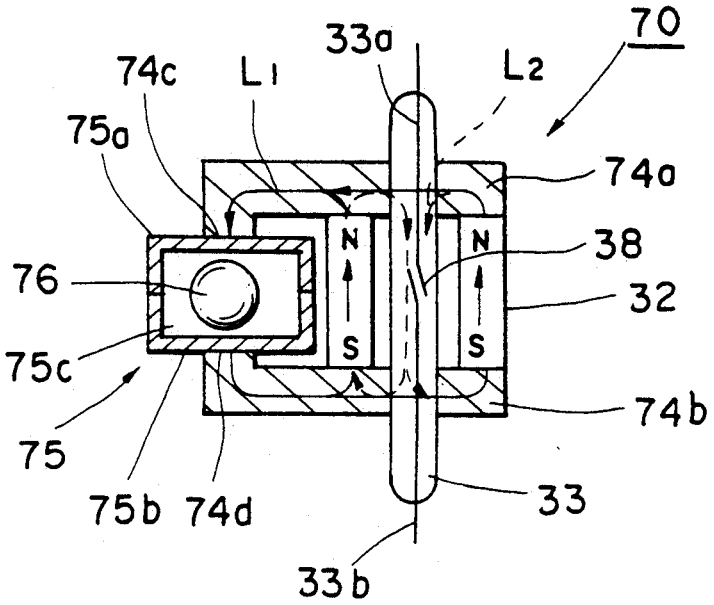
Figure 31:
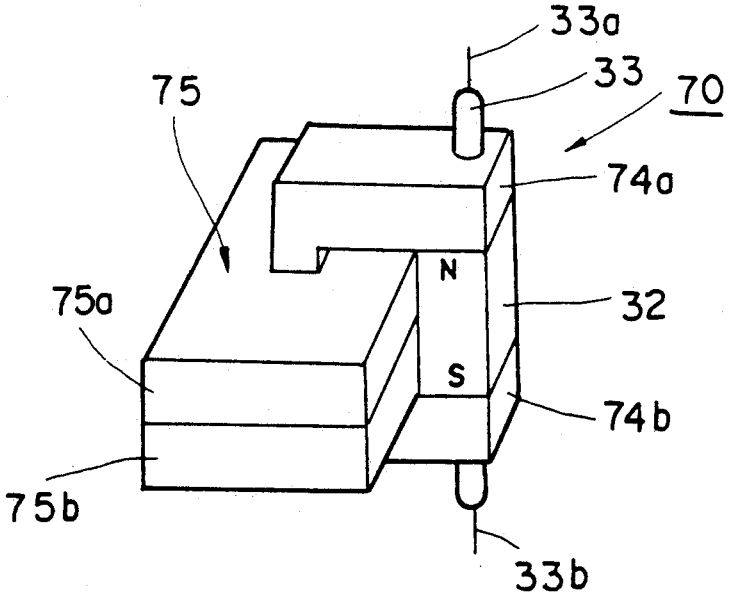

FIG. 30 is a sectional view showing further sensor 70 embodying the invention, and FIG. 31 is a perspective view showing the same sensor 70.

This sensor 70 is 90 degrees out of orientation of sensor 31 shown in FIGS. 24 and 25 for detecting impact accelerations in horizontal directions in a range of 360 degrees. This sensor is the same as sensor 31 except for spherical movable magnetic member 76 is used in lieu of cylindrical movable magnetic member 36, and parts having like functions are designated by like reference numerals or symbols.

Spherical movable magnetic member 76 is disposed for movement in horizontal directions in a range of 360 degrees in space 75c of non-magnetic case 75, and it opens and closes first magnetic circuit $L_1$ like member 36 in sensor 31.

Figure 32:
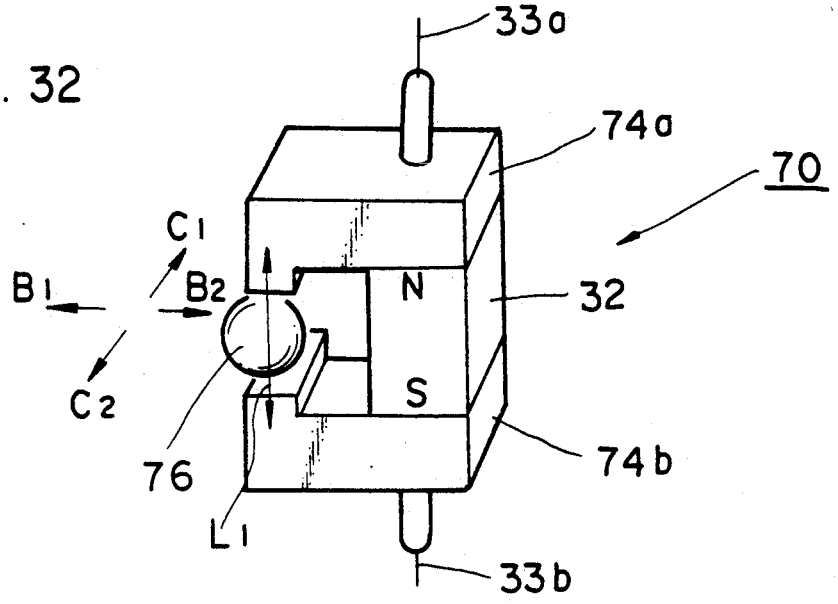

When an acceleration in excess of a predetermined value is applied, movable magnetic member 76 is movable not only in horizontal directions $B_1$, $B_2$, $C_1$ and $C_2$ but in any direction crossing first magnetic circuit $L_1$, as shown in FIG. 32.

Pair magnetic yokes 74a and 74b have bent ends 74c and 74d extending perpendicular to first magnetic circuit $L_1$ for generation of a predetermined magnetic force of attraction as in sensor 31.

Second magnetic circuit $L_2$ is constituted by permanent magnet 32, pair magnetic yokes 74a and 74b and reed switch 33.

Non-magnetic case 75 way be readily manufactured such that it consists of lids 75a and 75b for covering movable magnetic member 76.

The operation of sensor 70 will now be described with reference to FIGS. 33 and 34.

Figure 33:
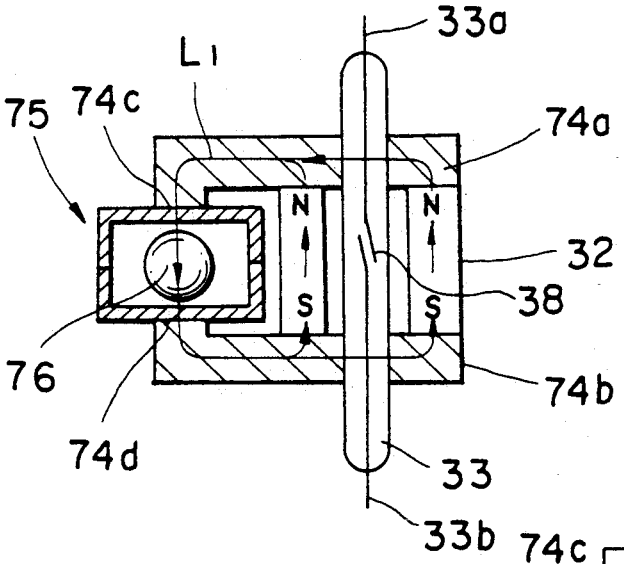

In a stationary state without any impact acceleration applied to case 75, as in sensor 31, movable magnetic member 76 is held in first magnetic circuit $L_1$ as shown in FIG. 33. In this state, first magnetic circuit $L_1$ is closed, while second magnetic circuit $L_2$ is open. Also, contacts 38 of reed switch 33 are broken apart.

Figure 34:
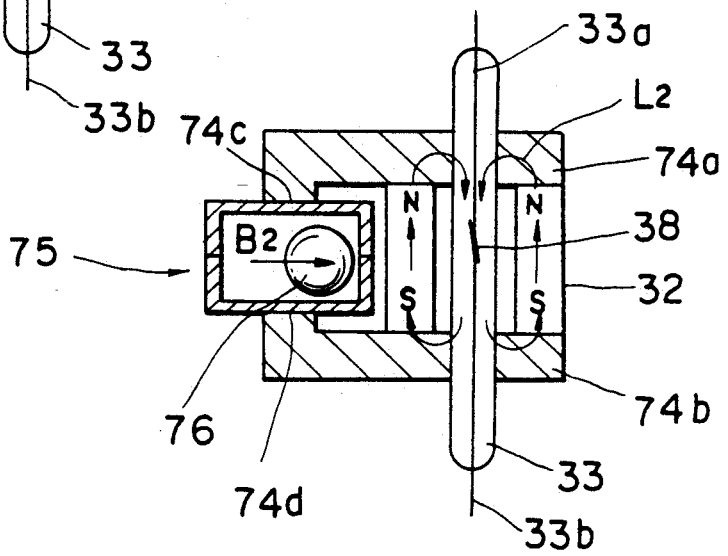

When an impact acceleration in excess of a predetermined value is applied to case 75 in rightward direction $B_2$ thereof, movable magnetic member 76 is moved by the acceleration in rightward direction $B_2$, as shown in FIG. 34, and the center of movable magnetic member 76 gets out of first magnetic circuit $L_1$ and is moved to a position that movable magnetic member 10 strikes the inner wall of case 75.

With the movement of movable magnetic member 76, first magnetic circuit $L_1$ is opened. When first magnetic circuit $L_1$ is opened, second magnetic circuit $L_2$ is closed, as shown in FIG. 34. At this time, contacts 38 of reed switch 33 are made.

When the impact acceleration vanishes, movable magnetic member 76 is attracted toward first magnetic circuit $L_1$ and is returned to the initial position.

With sensor 70, in addition to the effects obtainable with sensor 31, it is readily possible to detect impact accelerations in all circumferential directions. When the sensor is applied to a vehicle or the like, it is operated not only in case of collision from the front but also in cases of collisions in oblique and sidewise directions. Thus, one sensor can be sufficiently used for the cases of collisions in all directions in a range of 360 degrees.

Figure 35:
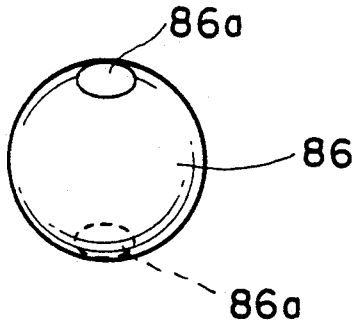

Movable magnetic member 76 way be of a shape as shown in FIG. 35. It is spherical with local cut flat surfaces 86*a* which are in contact with the inner wall surfaces of case 75, i.e., perpendicular to first magnetic circuit $L_1$. This arrangement has an effect of enhancing the magnetic force of attraction.

Figure 36:
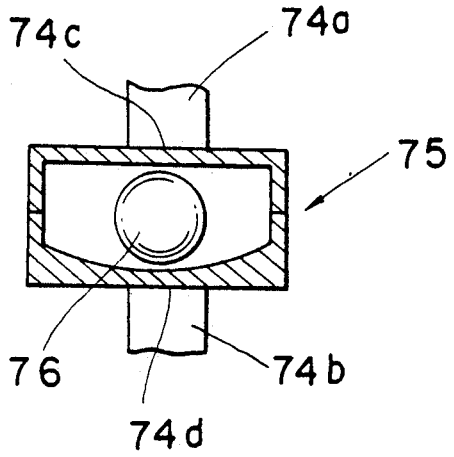
Figure 37:
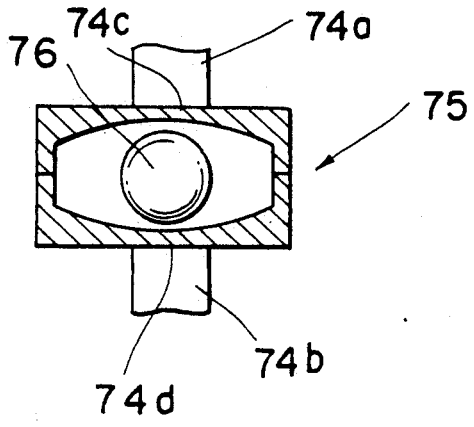

Case 75 may be formed with a concave bottom inner surface for receiving movable magnetic member 76 as shown in FIG. 36 or may be formed with concave top and bottom inner surfaces to facilitate the returning operation of movable magnetic member 76 as shown in FIG. 37.

The above embodiments are by no means limitative, and various changes and modifications are possible without departing from the scope of the invention. For example, by appropriately selecting the magnetic force of the magnetic circuit constituted by the permanent magnet, magnetic yokes and reed switch it is possible to adjust the sensitivity of detection of shocks or vibrations. Further, it is possible to adjust the detection sensitivity or response character by suitably selecting the material, size and shape of the permanent magnet, or suitably selecting the distance of magnetic gap present between permanent magnet and magnetic yokes or providing a magnetic gap in magnetic yoke itself and permitting suitable selection of the gap interval.

Figure 38:
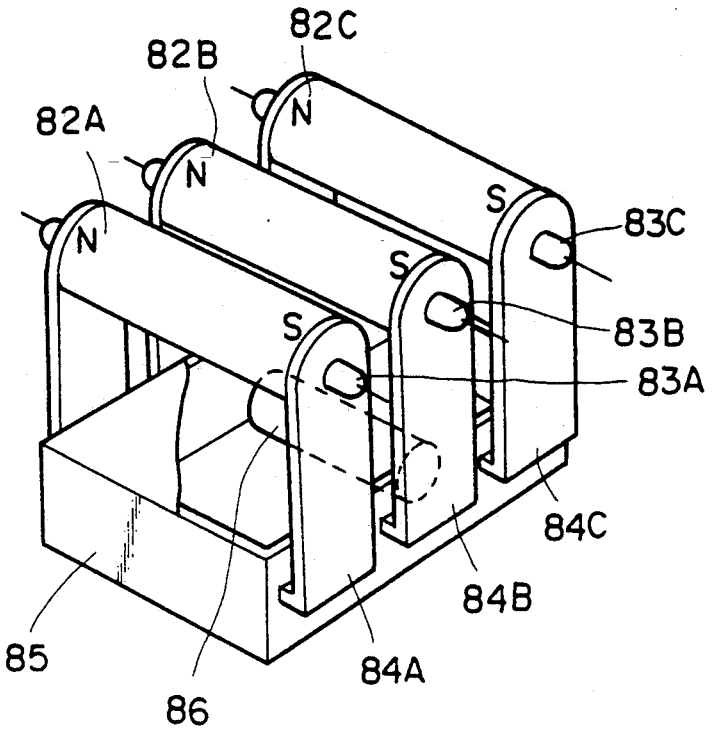
Figure 39:
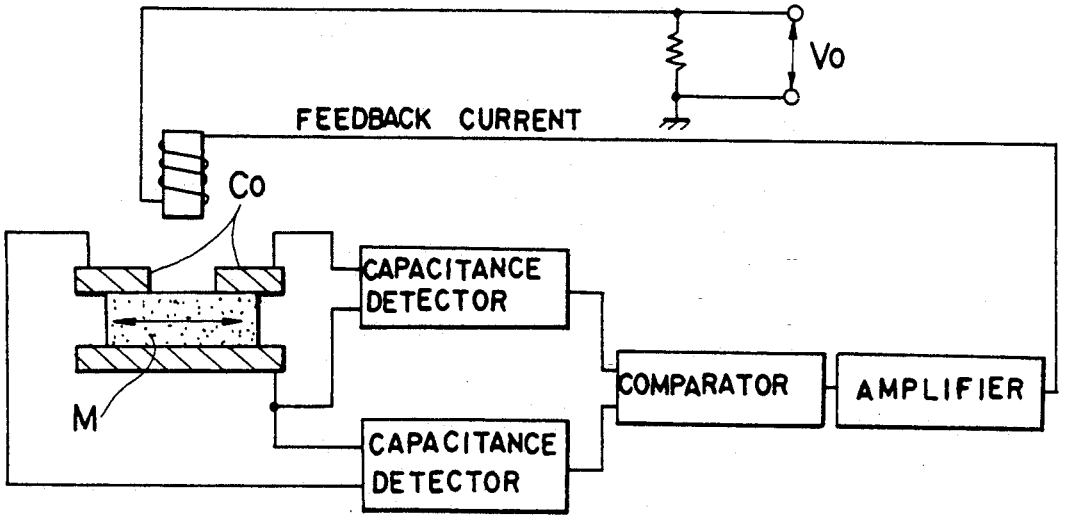
FIG. 39 PRIOR ART
FIG. 39 is a block diagram showing a prior art system.

Further, smoother movement of the movable magnetic member may be obtained by providing a magnetic fluid surrounding it. Further, while in the above embodiments only a single combination of magnetic yokes, movable magnetic member, reed switch and permanent magnet is provided, it is possible to provide a plurality of such combinations. For example, FIG. 38 shows a construction comprising three permanent magnets 82A to 82C, three magnetic yokes 84A to 84C and three reed switches 83A to 83C, these components being arranged in respective combinations juxtaposed with one another. This arrangement permits detection of both the magnitude and direction of accelerations.

While the invention has been particularly shown and described in reference to preferred embodiments thereof, it will be understood by those skilled in the art that changes in form and details may be made therein without departing from the spirit and scope of the invention.

What is claimed is:

1. An acceleration sensor comprising a movable permanent magnet, a case of a non-magnetic material having a space with said movable permanent magnet movable therein, a magnetic yoke having opposing end portions respectively provided on opposing ends of said case and extending in a direction crossing the directions of movement of said movable permanent magnet, and a reed switch for forming a closed magnetic circuit together with said movable permanent magnet and magnetic yoke.

2. An acceleration sensor according to claim 1, wherein said movable permanent magnet is rod-like.

3. An acceleration sensor according to claim 1, wherein said movable permanent magnet is spherical.

4. An acceleration sensor according to any one of claims 1 to 3, wherein further comprises a magnetic fluid provided around said movable permanent magnet.

5. An acceleration sensor according to any one of claims 1 to 3, wherein said magnetic yoke has a magnetic gap formed in a path constituting said closed magnetic circuit, said magnetic gap being variable for adjusting magnetic forces of attraction.

6. An acceleration sensor according to any one of claims 1 to 3, wherein said case has an inclined surface such that a central portion in directions of movement of said movable permanent magnet is lowest in level.

7. An acceleration sensor comprising a movable permanent magnet, a case having a space with said movable permanent magnet movable therein, a plurality of magnetic yoke pairs having opposing end portions respectively juxtaposed in the direction of movement of said movable permanent magnet and each including paired magnetic yokes each having one yoke provided on one end of said case and opposing one end of the other yoke which is provided in an opposing end of said case in a direction crossing directions of movement of said movable permanent magnet, and read switches each having paired contacts provided on other ends of magnetic yokes in each said pair.

8. An acceleration sensor comprising a movable permanent magnet, a case having a space with said movable permanent magnet movable therein, a pair of magnetic yokes each having one yoke provided on one side of said case and an opposing yoke provided on an opposing side of said case in a direction crossing the directions of movement of said movable permanent magnet, a reed switch having paired contacts provided on other ends of said magnetic yokes, and a C-shaped magnetic yoke disposed adjacent to said magnetic yoke pair and having ends opposing each other, said movable permanent magnet being adapted to be aligned to the opposing ends of said magnetic yoke pair or said C-shaped magnetic yoke.

9. An acceleration sensor according to claim 7 or 8, wherein said movable permanent magnet is rod-like.

10. An acceleration sensor according to claim 7 or 8, wherein said movable permanent magnet is spherical.

11. An acceleration sensor according to claim 7 or 8, wherein said magnetic yoke pair of magnetic yoke has a magnetic gap formed in its magnetic circuit, said magnetic gap being variable for adjusting magnetic forces of attraction.

12. An acceleration sensor according to claim 7 or 8, wherein said case has an inclined surface such that a central portion in directions movement of said movable permanent magnet is lowest in level.

13. An acceleration sensor operable in response to a predetermined acceleration so as to open a first magnetic circuit with a permanent magnet and close a second magnetic circuit with said permanent magnet so as to close a reed switch, comprising a movable magnetic member held stationary to said permanent magnet so as to close said first magnetic circuit when said acceleration sensor is held at a stationary state, wherein said movable magnetic member is moved in response to said predetermined acceleration by crossing and closing said second magnetic circuit.

14. An acceleration sensor according to claim 13, which further comprises a magnetic fluid provided around said movable magnetic member.

* * * * *